United States Patent [19]

Miller

[11] 4,114,530

[45] Sep. 19, 1978

[54] APPARATUS FOR PACKAGING COMPRESSIBLE STRIPS

[75] Inventor: Ward B. Miller, Waterville, Ohio

[73] Assignee: Owens-Corning Fiberglas Corporation, Toledo, Ohio

[21] Appl. No.: 809,214

[22] Filed: Jun. 23, 1977

[51] Int. Cl.[2] ..... B30B 5/04; B65H 17/14; B65B 63/04

[52] U.S. Cl. ..... 100/87; 53/118; 242/67.1 R; 242/DIG. 3

[58] Field of Search ..... 242/67.1 R, 67.3 R, 242/55, DIG. 3, 78.7, 75.1, 209, 192, 68.7, 75.1; 100/5, 76, 87, 88; 53/21 FW, 118

[56] References Cited

U.S. PATENT DOCUMENTS

| | | | |
|---|---|---|---|
| 3,637,161 | 1/1972 | Baur et al. | 242/209 |
| 3,671,033 | 6/1972 | Coast | 242/67.1 R |
| 3,911,641 | 10/1975 | Miller et al. | 100/5 |
| 3,964,235 | 6/1976 | Miller et al. | 53/118 |

*Primary Examiner*—George F. Mautz
*Attorney, Agent, or Firm*—Ronald C. Hudgens; Philip R. Cloutier; Allen D. Gutchess, Jr.

[57] ABSTRACT

Apparatus is provided for packaging compressible material, such as building insulation, in strip form. The compressible strip is wound into a roll and held under compression during rolling to form a compact package. The apparatus includes a main endless belt carried on a frame and positioned and driven in a manner to form a loop in itself which is in the path of the compressible strip being lineally moved toward the belt. The belt is driven to roll the strip on itself as it is moved into the loop, and means are provided for maintaining the belt under tension to place the strip in compression during rolling. When the roll is completed, part of a sub-frame for the belt is moved away from a main frame to cause the loop to open and automatically eject the compressed, packaged roll. A plurality of supporting belts is positioned under a portion of the loop and serves to aid in supporting the loop and the roll as it is being formed and also to provide the drive for the main belt. The supporting belts are driven so that the portions in contact with the main belt loop are in tension and preferably are timing belts. The belts are also at a steeper angle to the horizontal than heretofore.

10 Claims, 8 Drawing Figures

APPARATUS FOR PACKAGING COMPRESSIBLE STRIPS

This invention relates to improved packaging apparatus for packaging a strip of compressible material into a compressed roll.

The packaging apparatus can receive a compressible strip of insulation directly from the end of a production line. The strip is rolled on itself under compression and taped automatically to provide a finished, packaged roll which is automatically ejected from the apparatus. The insulation is not handled until it is in its complete packaged form. The amount of labor required is, accordingly, reduced compared to that heretofore needed in packaging such materials. The insulation is also compressed in the package to a degree exceeding that heretofore achieved.

More specifically, two, three, or more strips of building insulation are usually formed in side-by-side relationship and discharged longitudinally off the end of the production line. Each of the strips comprises a layer of compressible fibers, optionally held together by a binder and, in most instances, adhered to a backing sheet on which the fibers are deposited on the production line. The insulating strip is commonly from about 15 to about 23 inches wide, with the thickness of the fibrous insulating layer being from 2 inches up. A lengthy roll of such a strip, capable of covering up to 75 square feet, for example, can be quite bulky if not compressed substantially during packaging. In fact, the packaging should be limited only by the degree to which the fibers can return substantially to the original thickness of the layer after the package roll is opened. Heretofore, such strips have usually not been compressed to the maximum possible extent short of causing permanent deformation of the fibrous layer.

The packaging apparatus includes a main endless belt which forms a loop in itself located in the path of the compressible strip being lineally moved toward the belt from the production line. As the compressible strip is moved into the loop, the belt is moved in a manner such that the strip is rolled on itself with the backing sheet of the insulation strip, if any, facing outwardly. The belt is maintained under tension as the roll is wound so that increasing pressure is maintained on the roll as the loop enlarges to accommodate the ever increasing diameter of the roll being packaged. The compressible strip is cut to a predetermined length on the production line and, as the trailing end of the strip is moved toward the loop, tape is applied thereto. A portion of the tape is adhered to the trailing end of the strip and a portion extending rearwardly thereof is adhered to the previous wrap of the strip. The roll is completely packaged by the time the strip moves into the loop and turns approximately one more revolution to cause the tape to adhere to the previous wrap. At this time, a sub-frame supporting and positioning the lower loop portion of the main belt is swung away from the main frame to straighten the portion of the belt forming the loop, thereby causing the packaged roll to be discharged downwardly. Apparatus of a related nature is disclosed in U.S. Pat. Nos. 3,911,641 and 3,964,235.

In accordance with the invention, a plurality of relatively narrow supporting belts is located under a portion of the main belt forming loop and aid in supporting the loop and the strip during packaging. The supporting belts preferably are timing belts and are driven in a manner such that the portions in contact with the loop portion of the main belt are in tension. The timing belts also serve to drive the main belt and aid in forming the loop therein. The supporting belts are positioned at a steeper angle to the horizontal than belts heretofore employed. This causes the leading edge of the strip being packaged to move back into itself more effectively when forming the first wrap or core of the roll or package.

It is, therefore, a principal object of the invention to provide improved apparatus for packaging compressible material in strip form.

Other objects and advantages of the invention will be apparent from the following detailed description of a preferred embodiment thereof, reference being made to the accompanying drawings, in which.

Figure 1:
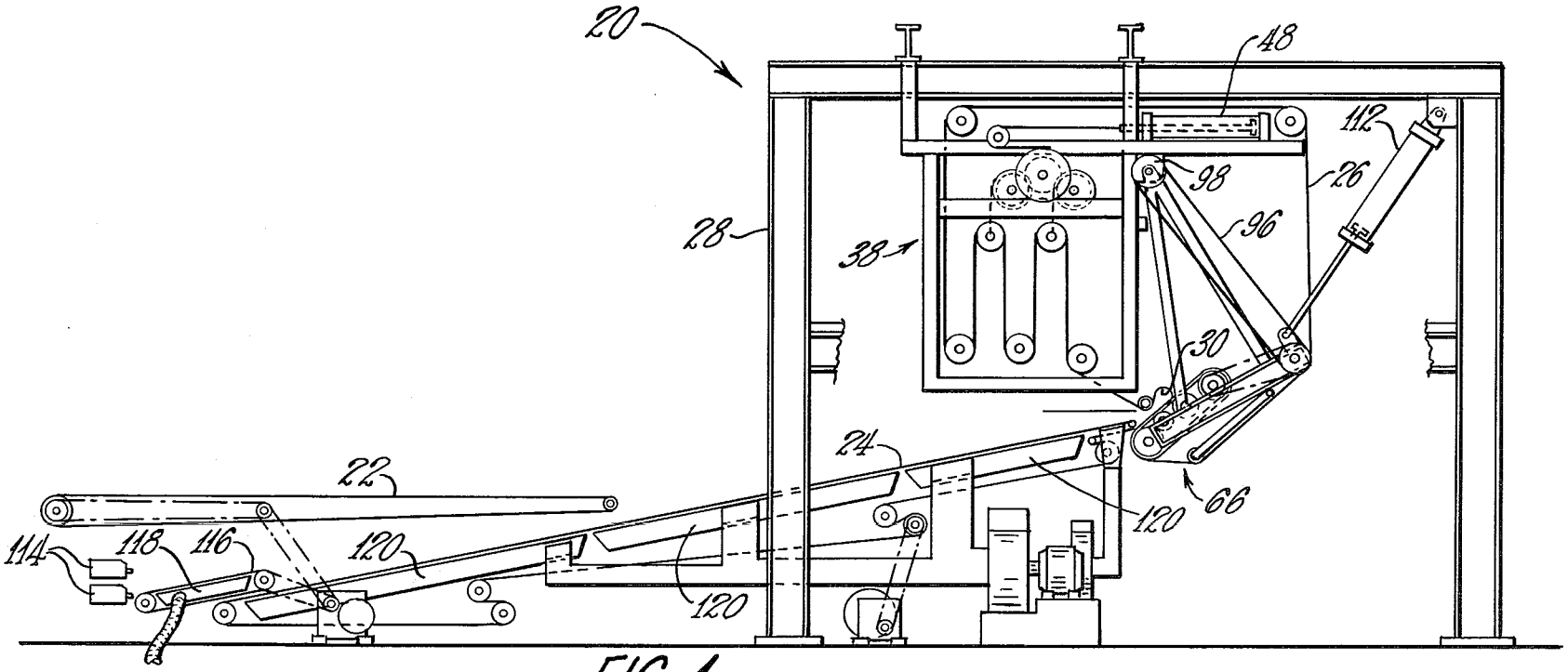
FIG. 1 is a somewhat schematic side view in elevation, with parts broken away, of packaging apparatus embodying the invention.

Referring to FIG. 1, packaging apparatus according to the invention is indicated at 20. A strip of insulation, specifically an insulating layer of glass fibers, with or without a backing sheet, is fed longitudinally to the packaging apparatus 20 from a production line, being cut to a predetermined length on the production line. The insulation is fed from the production line to a supply conveyor 22 and then moved up an inclined conveyor 24 toward a main endless belt 26 carried by a main frame 28. The belt 26 has a loop or pocket 30 formed therein which is in alignment with the inclined conveyor 24 to receive the forward end of the compressible strip of insulation.

Figure 2:
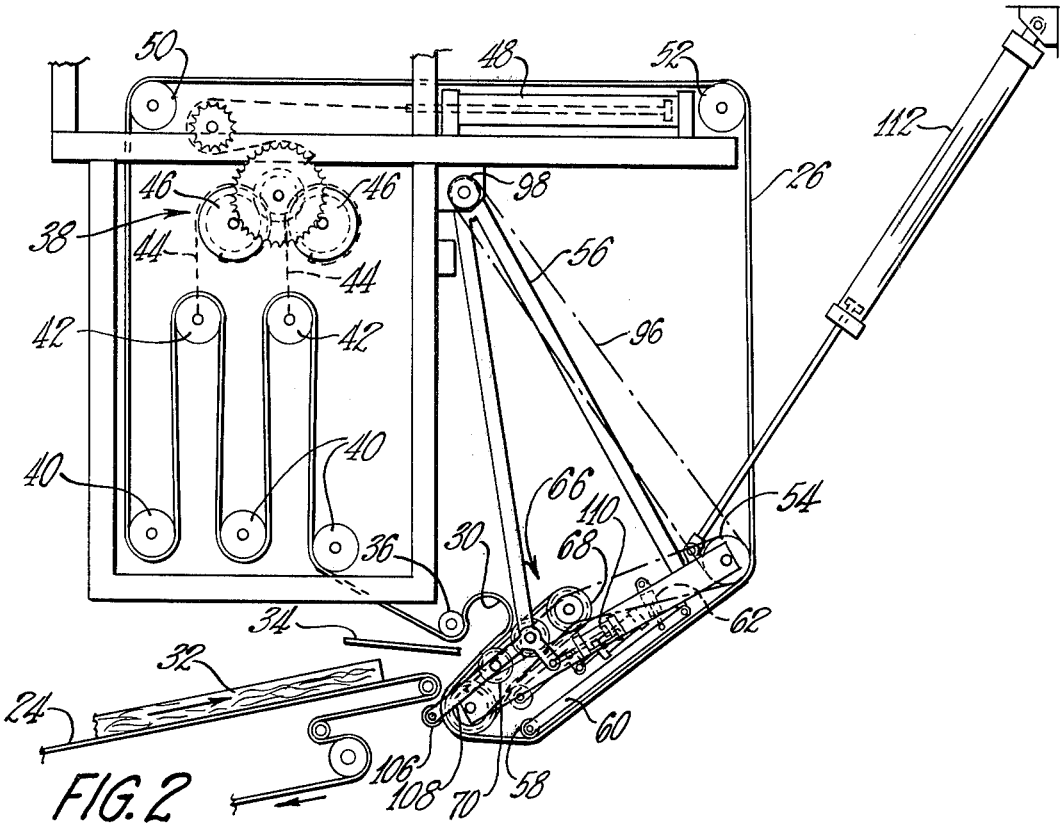
FIGS. 2–5 are enlarged, somewhat schematic side views in elevation of a portion of the packaging apparatus showing various components thereof in different positions during the packaging and discharging of a strip of compressible material.
Figure 3:
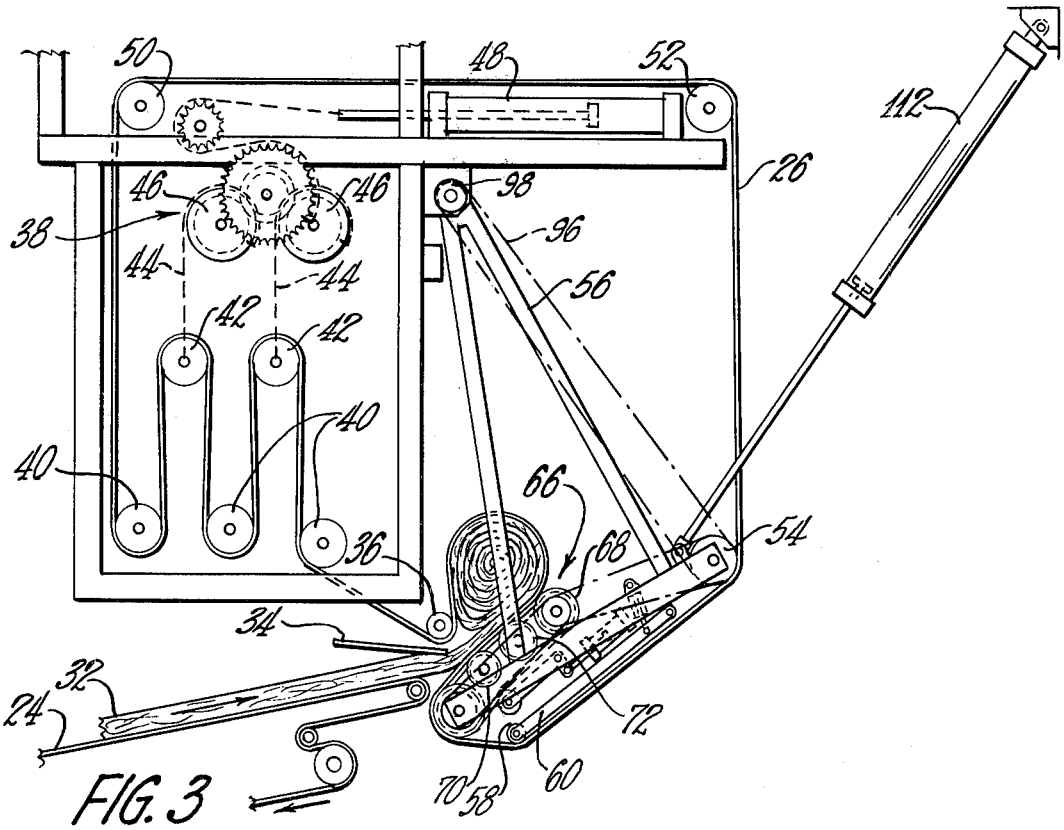
Figure 4:
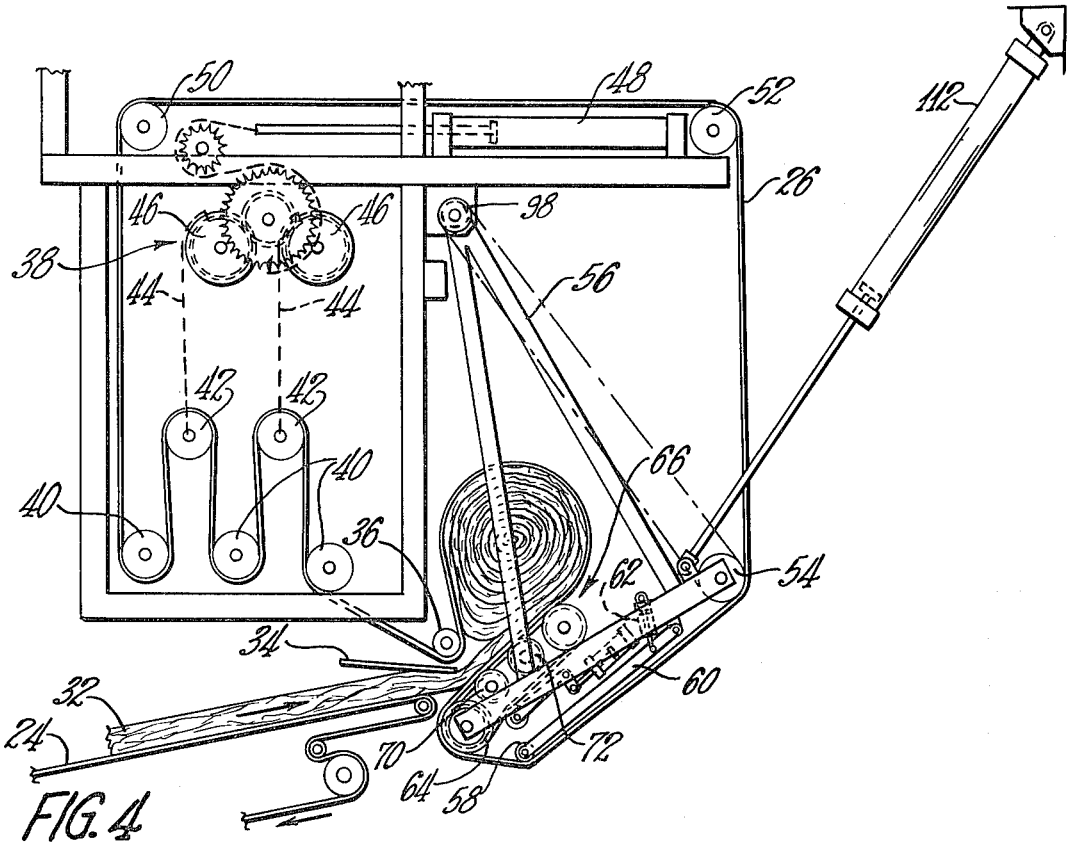

Referring to FIGS. 2–5, a strip 32 of insulation is shown moving up the conveyor 24 and directed by a guide plate 34 toward the throat or opening of loop 30. From the loop, the main belt 26 extends around a throat roll 36 to take-up or tension mechanism indicated at 38. This enables loop 30 to expand as the insulation rolls up therein and yet maintains tension on the belt in order to maintain a compressive force or pressure on insulation 32 as each wrap is rolled. The take-up mechanism 38 includes lower, stationary idler rolls 40, and upper, vertically-movable, take-up rolls 42. The rolls 42 are urged upwardly to place the belt in tension but move downwardly as the size of the loop 30 increases. Rolls 32 are supported by chains 44 which are wound on sprockets 46. The chains extend around the sprockets sufficiently to enable the take-up rolls 42 to move between their extreme upper and lower positions, as shown in FIGS. 2 and 4. Sprockets 46 are urged in a clockwise direction, as shown in FIG. 2, by spur gears, cams and pressure cylinder 48. This mechanism is shown and discussed more fully in the aforesaid U.S. Pat. No. 3,964,235 and will not be discussed in further detail.

Figure 6:
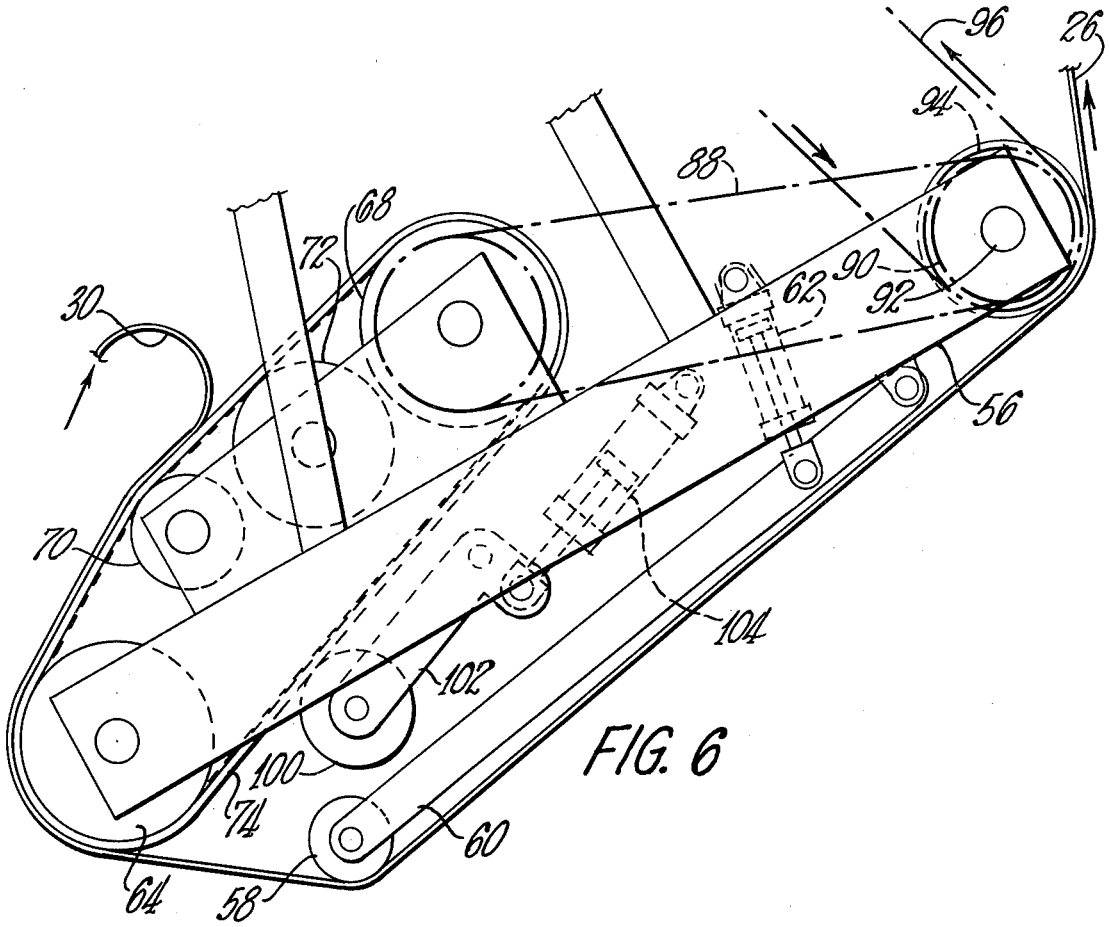
FIG. 6 is a further enlarged, somewhat schematic side view in elevation of certain components of the packaging machine according to the invention.
Figure 7:
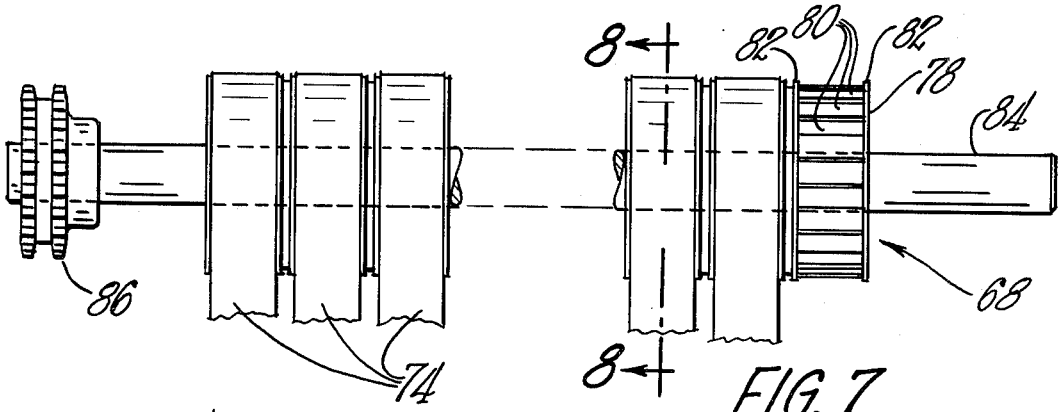
FIG. 7 is a fragmentary plan view of supporting belts and a drive arrangement shown in FIG. 6; and, FIG. 8 is a transverse sectional view taken along the line of 8—8 of FIG. 7.
Figure 8:
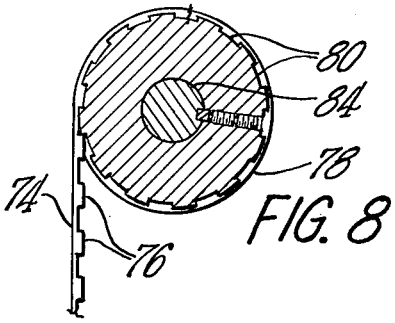

Beyond the take-up mechanism 38, the belt continues around idler rolls 50 and 52 and around lower idler roll 54 carried by pivotal sub-frame 56. The belt then extends below slack control roll 58 which is rotatably carried by lever 60 pivotally mounted on part of sub-frame 56. The lever is pivotally moved by pneumatic ram 62 (FIG. 6) which is also pivotally mounted on a portion of sub-frame 56, roll 58 controlling the slack in main belt 26 when frame 56 is opened. Main belt 26 then extends around tail roll 64 before returning to loop portion 30.

The tail roll 64 is part of supporting conveyor 66 which also has head or drive roll 68 and intermediate idler rolls 70 and 72. These are rotatably carried by a lower portion of pivotal sub-frame 56. The conveyor 66 also includes a plurality of narrow belts 74 arranged in spaced, side-by-side relationship and extending around tail roll 64 and drive roll 68. In a preferred form, belts 74 are timing belts with teeth 76 on the inner surfaces thereof. Drive roll 68 actually consists of a plurality of timing belt pulleys 78 having transverse recesses 80 which receive teeth 76. Timing belt pulleys 78 also have edge shoulders 82 which maintain belts 74 in spaced relationship. Tail roll 64 has a smooth cylindrical surface with collars (not shown) which, along with the shoulders 82, maintain belts 74 spaced apart.

Conveyor 66 and the upper runs of belts 74 are located at an angle of 40° to 50° to the horizontal, at least 10° steeper than heretofore. This, accordingly, places loop 30 at a steeper angle and enables the leading edge of insulation 32 to turn back on itself more readily to form the first wrap or core of the package.

Drive roll 68 and specifically timing belt pulleys 78 are mounted on and affixed to drive shaft 84 having double sprocket 86 thereon. This is connected by chains 88 (FIG. 6) to sprocket 90 located on jack shaft 92 and rotated through drive sprocket 94, chain 96, and main drive sprocket 98 (FIG. 1) by a suitable motor on frame 28. Take-up roll 100 (FIG. 6) is located below the return run of belts 74 and is mounted on lever 102 connected to ram 104 which urges roll 100 against belts 74.

Pinch roll 106 (FIGS. 2 and 5) urges main belt 26 toward tail roll 64 and belts 74 cause main belt 26 to be driven along with timing belts 74, when the pinch roll engages belt 26. Pinch roll 106 is rotatably mounted on pivoted L-shaped levers 108 which are operated through pneumatic ram 110.

Figure 5:
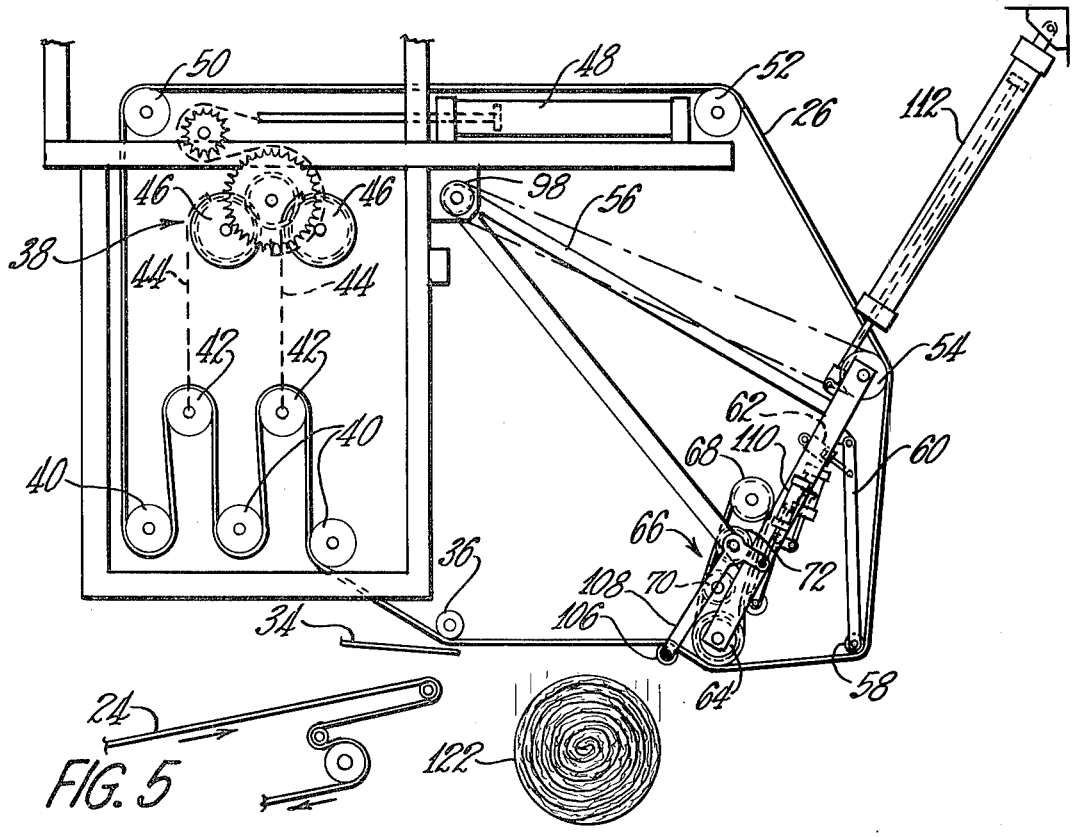

When the package is complete, pivotal sub-frame 56 is opened, as shown in FIG. 5, to straighten loop 30 and to discharge the package downwardly. For this purpose, pneumatic ram 112 is connected to a portion of sub-Frame 56 and to an upper corner portion of main frame 28. At this time, pinch roll 106 is also moved outwardly by ram 110 to stop the movement of main belt 26. After discharge, pinch roll 106 again is moved into engagement with belt 26 to cause the belt to immediately begin to be moved by tail roll 64 and to form loop 30 again.

To maintain the roll of the compressible strip in compression, tapes are applied to the trailing ends of strips 32, preferably about one-half the length of the tape being adhered to the trailing edge portion of the insulation, the other half being applied to the backing sheet of a previous wrap of insulation. For this purpose, one or more banks of tape dispensers 114 (FIG. 1) are located below conveyor 22 and supply the tape to transfer conveyor 116, and, hence, to conveyor 24 below the insulation. The plurality of banks enables refilling and servicing while maintaining some in use. The tape is dispensed with the adhesive side facing upwardly and suitable sensing and timing arrangements can be employed to dispense the tape at the proper time relative to the insulation moving toward loop 30. The transfer conveyor has a vacuum chamber 118 communicating with an upper run of a perforated belt thereon. Similarly, the inclined conveyor 24 has vacuum chambers 120 communicating with an upper run of a perforated belt thereon. The vacuum holds the tape down more effectively and prevents it from being deflected by air currents. The vacuum also enables conveyor 24 to grip the insulation.

In the operation of the packaging apparatus, the insulation is carried up conveyor 24 and into loop 30, as shown in FIGS. 3 and 4. As loop 30 enlarges, take-up rolls 32 move downwardly. As insulation strip 32 moves along the conveyors, a timing or sensing device causes dispensers 114 to dispense the tape so that about one-half of each length of tape is received under the trailing edge of the strip. After the trailing edge moves into loop 30, the trailing edge rotates at least another revolution to cause the remainder of the tape to be adhered to the surface of the last wrap of insulation. At this time, piston 112 is actuated to move the sub-frame 56 in a counterclockwise direction and straighten the loop to cause finished package 122 (FIG. 5) to be ejected.

Various modifications of the above-described embodiment of the invention will be apparent to those skilled in the art and it is to be understood that such modifications can be made without departing from the scope of the invention, if they are within the spirit and tenor of the accompanying claims.

I claim:

1. Apparatus for rolling and compressing a strip comprising a main endless belt, a portion of said belt defining a loop, means for placing said belt under tension to place the strip in compression as it is rolled in the loop, means for supporting a lower portion of said loop as the strip is rolled therein, said supporting means comprising a tail roll located below the loop, a drive roll spaced from said tail roll, and a plurality of supporting belts extending around said tail roll and said drive roll and having an upper run positioned to engage the lower portion of the loop, pinch roll means adjacent said tail roll for (1) pinching the main belt therebetween and (2) placing the upper run of the supporting belt in tension, said supporting belt being a timing belt with teeth on the inner surface thereof for engagement with correspondingly spaced grooves in said drive roll.

2. Apparatus according to claim 1 in which said drive roll comprises a plurality of separate timing pulleys mounted on a common shaft.

3. The apparatus of claim 1 including a plurality of idler rolls located between the tail roll and the drive roll and in engagement with the underside of the upper run of the supporting belts.

4. The apparatus of claim 1 wherein the tail roll includes a smooth peripherial surface for engagement with the supporting belt.

5. Apparatus according to claim 1 in which said drive roll is higher than said tail roll and places the upper run of said supporting belt on an angle to the horizontal.

6. Apparatus according to claim 5 in which said drive roll comprises a plurality of separate timing pulleys mounted on a common shaft.

7. Apparatus according to claim 5 in which at least a portion of the upper run is at an angle of 40° to 50° to the horizontal.

8. Apparatus according to claim 7 in which said drive roll comprises a plurality of separate timing pulleys mounted on a common shaft.

9. The apparatus of claim 8 including means for maintaining the supporting belts in spaced side-by-side relationship.

10. The apparatus of claim 9 wherein the spacing means comprises shoulders on each of said pulleys.

* * * * *